US006047155A

United States Patent [19]

Pietrowski et al.

[11] Patent Number: 6,047,155

[45] Date of Patent: Apr. 4, 2000

[54] COLOR PRINTING MACHINE HAVING AC PRETRANSFER TONER TREATMENT

[75] Inventors: Kenneth W. Pietrowski, Penfield; Charles A. Radulski, Macedon, both of N.Y.

[73] Assignee: Xerox Corporation, Stamford, Conn.

[21] Appl. No.: 09/373,933

[22] Filed: Aug. 13, 1999

[51] Int. Cl.[7] ..... G06G 15/01

[52] U.S. Cl. ..... 399/296; 399/231; 399/232

[58] Field of Search ..... 399/296, 223, 399/231, 290, 89; 361/225

[56] References Cited

U.S. PATENT DOCUMENTS 5,371,579 12/1994 Bisaiji ..... 399/296
5,613,172 3/1997 Pietrowski et al. ..... 399/50
5,742,871 4/1998 May et al. ..... 399/89
5,749,034 5/1998 Folkins ..... 399/303
5,778,288 7/1998 Tabb et al. ..... 399/231
5,848,335 12/1998 Folkins et al. ..... 399/186

*Primary Examiner*—Quana Grainger
*Attorney, Agent, or Firm*—John M. Kelly

[57] ABSTRACT

A color electrophotographic printer that prepares a composite toner image for transfer by exposing an image area containing the composite toner image to an erase lamp and then running the composite toner image by an AC scorotron.

14 Claims, 1 Drawing Sheet

COLOR PRINTING MACHINE HAVING AC PRETRANSFER TONER TREATMENT

FIELD OF THE INVENTION

This invention relates to electrophotographic printers. More particularly it relates to pretransfer toner treatment in color electrophotographic printers.

BACKGROUND OF THE INVENTION

Electrophotographic marking is a well-known and commonly used method of copying or printing documents. Electrophotographic marking is performed by exposing a light image representation of a desired document onto a substantially uniformly charged photoreceptor. In response to that image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration such that a desired composite color image results. That composite color image is then transferred and fused onto a substrate.

While the REaD IOI process is beneficial it is not without problems. One set of problems relates to transferring the composite color image onto a substrate. Toner transfer is complicated because the REaD IOI process produces a composite toner layers having highly variable charge magnitudes and distributions. For example, at the surface of the composite toner layer some of the toner might have a very low, possible even an opposite polarity, charge while some toner might have a high charge magnitude. These variations, which are likely a result of the recharging steps, produce toner surface potentials that are widely variable. Model projections suggest that the problem increases with the number of recharge steps a toner layer received.

A prior art approach to improving transfer is to use a DC biased corona device to add right-sign charge to the top of a composite toner layer comprised of multiple and or single toner layers. While this approach is promising, it is difficult to create the proper charge distribution in the various toner layers simultaneously. Achieving a charge distribution that provides good transfer for some of the toner (say a black toner layer) creates a poor distribution degrading transfer for some of the remaining toner (say a cyan or composite blue layers). Therefore, a new approach for simultaneously optimizing the charge distributions in single and multiple composite layers for transfer would be beneficial.

SUMMARY OF THE INVENTION

The principles of the present invention provide for multiple color electrophotographic printers with improved toner transfer. An electrophotographic printer according to the principles of the present invention includes an erase lamp that exposes a photoreceptor belt with a toner image prior to transfer so as to reduce photoreceptor voltages. Additionally, an AC scorotron supplies both polarities of ions as required to the composite toner image comprised of single and or multiple toner layers such that the toner charge distribution is optimized and the difference in surface potentials between the toner images is reduced. A DC bias applied to the AC scorotron coronodes can be incorporated to influence the balance of positive and negative ions generated in the corona.

BRIEF DESCRIPTION OF THE DRAWINGS

Other aspects of the present invention will become apparent as the following description proceeds and upon reference to FIG. 1, which schematically illustrates a four cycle electrophotographic printing machine that incorporates the principles of the present invention.

DETAILED DESCRIPTION OF A PREFERRED EMBODIMENT OF THE INVENTION

Figure 1:
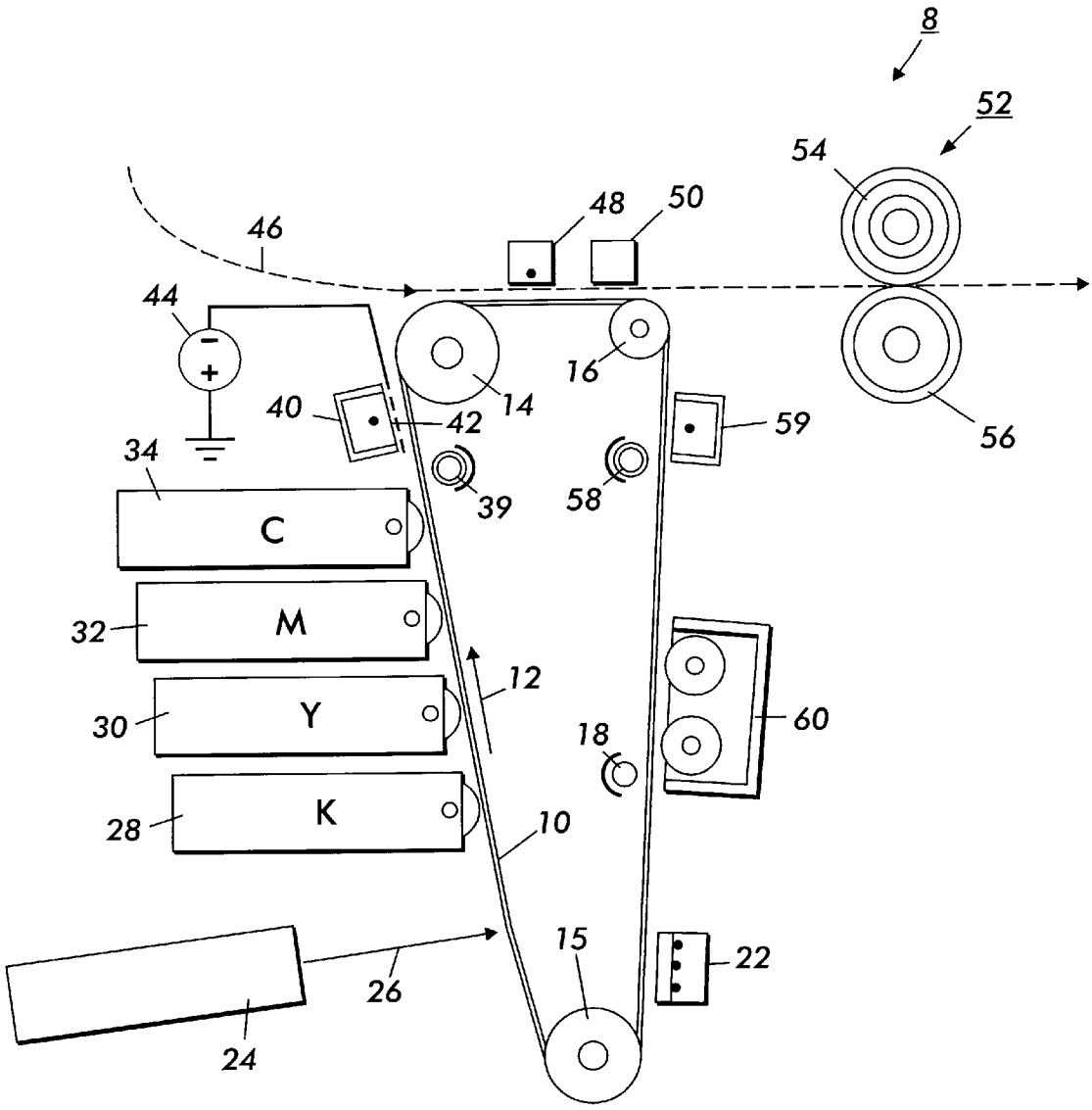

Referring now to FIG. 1, a preferred embodiment of the present invention is a four cycle electrophotographic printing machine 8 which incorporates an erase lamp after a fourth developing station. While the preferred embodiment uses individual subsystems that are known in the prior art, they are organized in a new, useful, and nonobvious manner.

The printing machine 8 includes an Active Matrix (AMAT) photoreceptor belt 10 which travels in the direction indicated by the arrow 12. Belt travel is brought about by mounting the photoreceptor belt about a drive roller 14 (that is driven by a motor which is not shown) and tension rollers 15 and 16.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas, since each image area is processed in the same way a description of the processing of one image area suffices to fully explain the operation of the printing machine.

As mentioned, the production of a color document takes place in 4 cycles. The first cycle begins with the image area passing a "precharge" erase lamp 18 that illuminates the image area so as to cause any residual charge which might exist on the image area to be discharged. Such erase lamps are common in high quality systems and their use for initial erasure is well known.

The image area, processing stations, belt travel, and cycles define two relative directions, upstream and downstream. A given processing station is upstream of a second processing station if, in a given cycle, the imaging area passes the given processing station after it passes the second processing station. Conversely, a given processing station is downstream of a second if, in a given cycle, the imaging area passes the given processing station before it passes the second processing station.

As the photoreceptor belt continues its travel the image area passes through a charging station comprised of an AC scorotron 22. To charge the image area in preparation for exposure to create a latent image for black toner the AC scorotron charges the image area to a substantially uniform potential of, for example, about −500 volts. It should be understood that the actual charge placed on the photoreceptor for the black toner (and the other toner layers that are subsequently described) will depend upon many variables, such as toner mass and the settings of a subsequent development station (see below).

After passing the charging station the image area advances until it reaches an exposure station 24. At the exposure station the charged image area is exposed to a modulated laser beam 26 that raster scans the image area such that an electrostatic latent representation of a black image is produced. For example, illuminated sections of the image area might be discharged by the beam 26 to about −50 volts. Thus after exposure the image area has a voltage profile comprised of relatively high voltage areas of about −500 volts and of relatively low voltage areas of about −50 volts.

After passing the exposure station 24 the exposed image area passes a black development station 28 which deposits negatively charged black toner particles onto the image area. The charged black toner adheres to the illuminated areas of the image area thereby causing the voltage of the illuminated parts of the image area to be about −200 volts. The non-illuminated parts of the image area remain at approximately −500 volts.

After passing the black development station the image area advances past a number of other stations, whose purposes are described subsequently, and returns to the precharge erase lamp 18. The second cycle then begins.

If either AC re-charging or split re-charging were directly used to recharge the image areas in the second cycle, significant amounts of black toner particles might be pulled off of the photoreceptor and deposited into the yellow developer, thereby causing Black in Yellow contamination. However, it has been found that a successful AC only recharge can be performed if the photoreceptor is first exposed so as to reduce the charges on the image area prior to recharging. In the electrophotographic printing machine 8 this is performed using the precharge erase lamp 18 to expose the image area. Therefore, as the image area advances past the precharge erase lamp 18, that lamp illuminates the image area.

After passing the precharge erase lamp the AC scorotron 22 recharges the image area to the charge level desired for exposure and development of the yellow image. Beneficially the AC scorotron has a high slope: a small voltage variation on the image area results in large variations in charging currents. The voltage applied to the metallic grid of the AC scorotron 22 can be used to control the voltage at which charging currents are supplied to the image area.

The recharged image area with its black toner layer then advances to the exposure station 24. The exposure station exposes D the image area with the beam 26 so as to produce an electrostatic latent representation of a yellow image. As an example of the charges on the image area, the non-illuminated parts of the image area might have a potential about −450 while the illuminated areas are discharged to about −50 volts.

After passing the exposure station 24 the now exposed image area advances past a yellow development station 30 that deposits yellow toner onto the image area. Since the image area already has a black toner layer the yellow development station should use a scavengeless developer.

After passing the yellow development station the image area and its two toner layers advance past the precharge exposure lamp, which is once again illuminated so as to discharge the image area. This is the start of the third cycle. The AC scorotron 22 recharges the image area and its two toner layers in preparation for the third exposure station. The exposure station 24 again exposes the image area to the beam 26, this time with a light representation that discharges some parts of the image area to create an electrostatic latent representation of a magenta image. The image area then advances through a magenta development station 32 that deposits a third toner layer on the image area. This third magenta layer could be developed on a bare photoreceptor or on the previously developed image to create a red color for example.

The image area with its three toner layers then advances past the illuminated precharge erase lamp 18 and the fourth cycle begins. The AC scorotron 22 again recharges the image area (which now has three toner layers) to produce the desired charge on the photoreceptor. The substantially uniformly charged image area with its three toner layers then advances once again to the exposure station 24. The exposure station exposes the image area again, this time with a light representation that discharges some parts of the image area to create an electrostatic latent representation of a cyan image. After passing the exposure station the image area passes the cyan development station 34. The cyan development station, also a scavengeless developer, advances cyan toner onto the image area.—as either a single layer or on previously developed layers to create other colors.

After passing the cyan development station the image area has four toner layers which together make up a composite color toner image. This composite color toner image can consist of regions void of toner and regions having one, two, three or four colors. That composite color toner image is comprised of individual toner particles that have widely varying charge distributions. Indeed, some of those particles take a positive charge or a very low or high right sign charge. Transferring such a composite toner image onto a substrate would result in a degraded final image. Therefore it is beneficial to prepare the composite color toner image for transfer.

Preparation for transfer is partially performed by illuminating the image area using a pre-transfer erase lamp 39 so as to discharge most of the residual charges on the image area. As shown in FIG. 1, the pretransfer erase lamp is beneficially located adjacent the inside surface of the photoreceptor belt 10. Locating the pre-transfer erase lamp in this position allows for a particularly compact design since a space around the photoreceptor that is upstream of all of the development stations but downstream of the transfer station (described subsequently) need not be used.

After passing the pretransfer erase lamp 39 the untoned portions of the image area are discharged to a substantially uniform level. However, the toner layers have charges that vary widely and can include both positive and negative charges. To further prepare the toner layers for transfer it is beneficial to both drive the toner layer surface potentials toward that of the untoned portions of the image area and to add charge of the appropriate polarity and magnitude to various portions of the image having different numbers of color toner layers. Black, yellow, cyan and magenta portions of the image, for example, contain a single color layer. Red, blue and green colors contain two and process black three. This is performed by running the image area past an AC scorotron 40 that has its grid 42 connected to the desired surface potential 44. The AC scoroton (beneficially a high slope AC scorotron) supplies positive and negative ions as required so as to add or neutralize the toner layer surface charges such that the potential across the various toner layers is substantially that of the untoned portions of the image area and equal to each other. A judicious choice of grid potential will enable positive charge to be delivered to portions of the image requiring a reduction in negative charge, and negative charge to other areas of the image requiring an increase in negative charge. This operation optimizes the charge distribution in all portions of the composite toner image so as to enhance transfer.

The image area then continues to advance in the direction 12, past the drive roller 14. A substrate 46 is then placed over the image area using a sheet feeder (which is not shown). As the image area and substrate continue their travel they pass a transfer corotron 48. That corotron applies positive ions onto back of the substrate 46. Those ions attract the negatively charged toner particles onto the substrate. Since the image layer has a substantially uniform surface potential the corotron 48 produces a substantially uniform transfer field that improves the toner transfer characteristics.

As the substrate continues its travel it passes a detack corotron 50. That corotron neutralize, some of the charge on the substrate 46 to assist separation of the substrate from the photoreceptor 10. As the leading edge of the substrate moves around the tension roller 16 the leading edge separates from the photoreceptor. The substrate 46 is then directed into a fuser 52 where a heated fuser roller 54 and a pressure roller 56 create a nip through which the substrate passes. The combination of pressure and heat at the nip causes the composite color toner image to fuse into the substrate. After fusing, a chute, not shown, guides the support sheets to a catch tray, also not shown, for removal by an operator.

After the substrate separates from the photoreceptor belt 10 the image area continues its travel and passes a preclean erase lamp 58. That lamp neutralizes most of the charge remaining on the photoreceptor belt. After passing the preclean erase lamp the residual toner and/or debris on the photoreceptor is treated with an AC corotron 59 to optimize the residual charge and debris for removal at a cleaning station 60. At the cleaning station, two electrically biased cleaning rolls remove residual toner particles and debris from the image area. This marks the end of the 4th cycle. The image area then passes once again to the precharge erase lamp and the start of another 4 cycles.

It is to be understood that while the figures and the above description illustrate the present invention, they are exemplary only. Others will recognize numerous modifications and adaptations of the illustrated embodiments that will remain within the principles of the present invention. Therefore, the present invention is to be limited only by the appended claims.

What is claimed:

1. A color printing machine, comprising:

a photoreceptor moving in a predetermined direction, said photoreceptor having an image area with a composite toner image comprised of a plurality of color toner image, wherein said composite toner image has varying charge distributions, said image area further having untoned portions at a first potential;

a pretransfer erase lamp for exposing said image area so as to reduce said first potential to a second potential;

a pretransfer AC scorotron having a control grid at a grid potential such that said AC scorotron supplies ions to said composite toner image such that said toner image surface potential is substantially uniform; and a transfer station located downstream of said pretransfer AC scorotron, said transfer station for transferring said composite toner image onto a substrate.

2. A color printing machine according to claim 1, wherein said composite toner image includes a black toner layer.

3. A color printing machine according to claim 1, wherein said composite toner image includes a yellow toner layer.

4. A color printing machine according to claim 1, wherein said composite toner image includes a magenta toner layer.

5. A color printing machine according to claim 1, wherein said composite toner image includes a cyan toner layer.

6. A color printing machine according to claim 1, further including a fusing station for fusing said transferred composite toner image with said substrate.

7. A color printing machine according to claim 4, further including a cleaning station for removing residual toner and debris from said photoreceptor.

8. A color printing machine according to claim 1, wherein said pretransfer erase lamp is upstream of said pretransfer AC scorotron.

9. A color printing machine according to claim 6, wherein said pretransfer erase lamp is inside said photoreceptor.

10. A color printing machine according to claim 1, wherein said pretransfer AC scorotron is a wire scorotron.

11. A color printing machine according to claim 1, wherein said pretransfer AC scorotron has a DC bias applied to the coronode(s) to effect the balance of ion generation.

12. A color printing machine according to claim 1, wherein said grid potential produces a composite toner image surface potential that is substantially equal to said second potential.

13. A color printing machine according to claim 1, wherein said grid potential is substantially equal to said second potential.

14. A color printing machine according to claim 1, wherein said grid potential optimizes the charge distribution of composite toner layers.

* * * * *